US005555899A

United States Patent [19]

Foreman

[11] Patent Number: 5,555,899

[45] Date of Patent: Sep. 17, 1996

[54] HAIR LIQUID APPLICATOR

[76] Inventor: Karen A. Foreman, 177 E. Dansville Rd., Dansville, Mich. 48819

[21] Appl. No.: 331,988

[22] Filed: Oct. 31, 1994

[51] Int. Cl.[6] ..... A45D 24/22

[52] U.S. Cl. ..... 132/114; 132/116; 132/112; 132/113

[58] Field of Search ..... 132/112, 113, 132/114, 116

[56] References Cited

U.S. PATENT DOCUMENTS

| | | | |
|---|---|---|---|
| 1,686,981 | 10/1928 | Olson | 132/114 |
| 2,922,425 | 1/1960 | Lerner et al. | 132/112 |
| 3,457,928 | 7/1969 | Kurshenoff | 132/113 |
| 5,054,504 | 10/1991 | Winrow | 132/114 |
| 5,311,887 | 5/1994 | Ramsey | 132/114 |

*Primary Examiner*—John G. Weiss
*Assistant Examiner*—Pedro Philogene
*Attorney, Agent, or Firm*—Duncan F. Beaman

[57] ABSTRACT

An applicator for applying a hair treatment liquid adjacent the hair roots and scalp wherein only the hair root area is treated. The applicator includes a plurality of fingers each having a free terminating end for insertion of the fingers into the hair adjacent the scalp and passages within the fingers communicate with a liquid hair treatment supply in the form of a squeeze bottle. The fingers' passages outlets are located adjacent the fingers' ends and on the underside thereof to control hair liquid distribution and prevent snagging the hair.

2 Claims, 1 Drawing Sheet

HAIR LIQUID APPLICATOR

BACKGROUND OF THE INVENTION

1. Field of the Invention

The invention pertains to applicators for applying a hair liquid to the hair root area adjacent the scalp without applying the liquid to other portions of the hair.

2. Description of the Related Art

When applying hair treating liquids and gels to human hair, the liquid, such as a gel, color, or the like, is externally applied to the hair and massaged into the hair to permit the coloring, or the like, to penetrate the hair to its maximum depth adjacent the scalp.

As is well known, colored hair must be periodically treated adjacent the scalp at the hair root area in order to maintain a uniform coloring throughout the hair length, and even though it is only the portions of the hair adjacent the scalp that require treatment, conventional systems for applying the liquid to the hair are not as selective as is desired and the location of dispensing of the liquid cannot be accurately controlled. Such conventional practices require greater amounts of treatment liquid than are necessary, and as each application of liquid, such as coloring, I will be applied to areas of the hair that do not require treatment, excessive exposure of the hair to coloring chemicals occurs resulting in deterioration of the hair characteristics.

OBJECTS OF THE INVENTION

It is an object of the invention to provide a hair liquid applicator capable of applying hair treatment liquids only to the root area hair adjacent the scalp to minimize the amount of treatment liquid required, and minimize deleterious effects upon the hair.

It is a further object of the invention to provide a hair liquid applicator of economical construction which requires minimal skills for selectively applying a hair treatment liquid only to the hair root area adjacent the scalp.

An additional object of the invention is to provide a hair treatment applicator which may be used by operators of ordinary skill which comfortably separates the hair prior to application of the liquid, applies the hair treatment liquid only adjacent the scalp permitting the hair liquid to be selectively applied to the hair root area to achieve the most efficient utilization of the treatment liquid and does not snag or pull the hair during use.

SUMMARY OF THE INVENTION

A hair liquid applicator in accord with the invention consists of a body, preferably formed of molded synthetic plastic, having a cavity defined therein for receiving the threaded neck of a squeeze bottle in which the hair treatment liquid is stored.

The body of the applicator includes a plurality of substantially parallel spaced fingers of uniform length. Each of the fingers includes a rounded, convex, free terminating end, and the transverse cross sectional area of the teeth uniformly increase from the finger end to the applicator body. Preferably, the fingers are of an elongated conical configuration.

A longitudinal passage is defined within each finger, and the inner ends of the finger passages communicate with a manifold passage defined in the body which, in term, communicates with a supply passage communicating with the body cavity and hair treatment supply reservoir.

The outer end of each finger passage includes an outlet which intersects the lower side of the associated finger slightly inwardly or behind the rounded finger terminating edge. Such a construction insures that the liquid will be deposited adjacent the scalp, and as the finger passage outlet extends downwardly, rather than forwardly, with respect to the length of the associated finger, the likelihood of the passage outlet snagging upon hairs is minimized.

In use, the ends of the fingers of the applicator are placed against the scalp and the fingers are pushed into the hair along the scalp. Once the fingers have adequately penetrated the hair, and the finger terminating ends are located adjacent the scalp, the applicator is slowly withdrawn along the path that it entered the hair with a zig-zag motion with the free ends of the fingers maintained adjacent the scalp. As the applicator is pulled backwardly, the squeeze bottle is compressed to expel the treatment liquid from the finger passages upon the scalp and hair root area adjacent thereto, and the application of the hair liquid to the scalp and hair root area will continue until the finger outer ends leave the hair. This process is repeated until all of the hair has been treated. Thereupon, gentle massaging of the hair will insure that the treatment liquid deposited adjacent the scalp and hair root area will adequately contact the hair roots to achieve the desired coloring, and the hair may then be rinsed, washed, or the like.

From the above description, it will be appreciated that the hair treatment liquid is only applied adjacent the scalp and hair root area, and the outer portion of the hair strands will not be exposed to the treatment liquid.

The simplicity of the construction of the device, and the use of the squeeze bottle supply reservoir, permits the applicator to be easily cleaned, and, if desired, a variety of treatment liquids may be sequentially used with a common applicator. The fact that the finger passage outlets are located at the underside of the fingers provides the desired comfort and prevents hair snagging, and apparatus in accord with the invention achieves the desired objectives.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
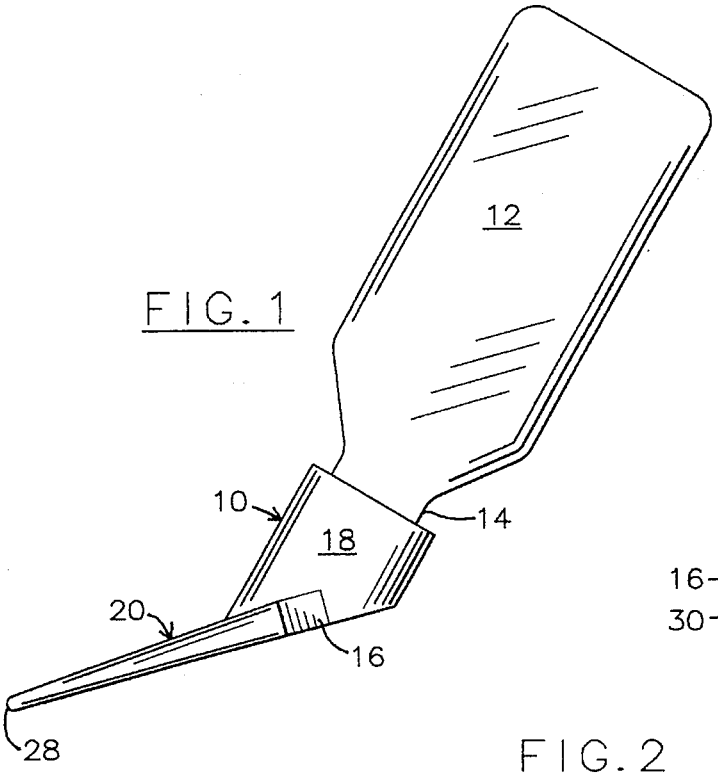
FIG. 1 is an elevational view of a hair liquid applicator in accord with the invention, the squeeze bottle being shown.

With reference to the drawings, the hair liquid applicator in accord with the invention is generally indicated by reference numeral 10, and a conventional resiliently compressible squeeze bottle 12 is mounted upon the applicator 10 in a manner as later described. The squeeze bottle 12 includes a threaded neck 14 as will be appreciated from FIG. 1.

The applicator 10 includes a body 16 which is preferably formed of a molded synthetic plastic material, and, preferably, is made of an attractive opaque color, but the body may also be molded of a transparent plastic material, if desired. The body 16 includes a tubular stem 18 and a plurality of fingers 20. The cavity 22 is of a generally cylindrical configuration and is concentrically formed within the stem 18, and includes threads 24 adjacent its outer end.

Figure 2:
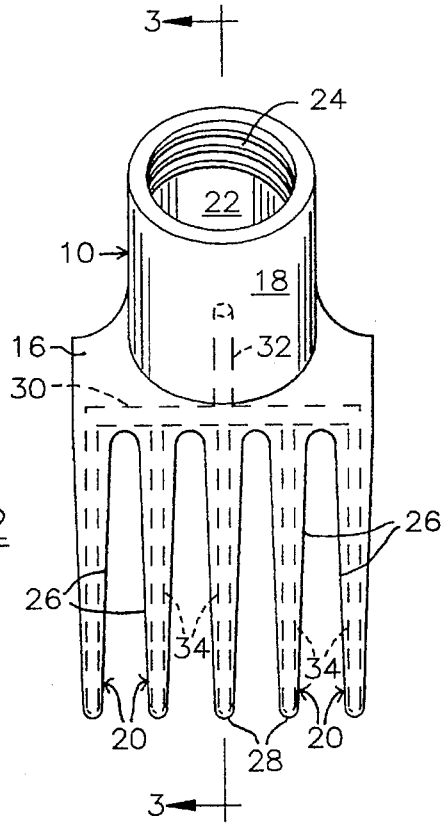
FIG. 2 is a top plan view of the applicator, per se, the squeeze bottle having been removed therefrom.
Figure 3:
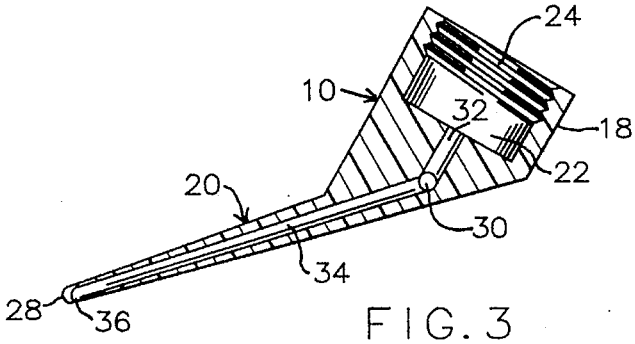
FIG. 3 is an elevational sectional view of the applicator as taken along Section 3—3 of FIG. 2.
Figure 4:
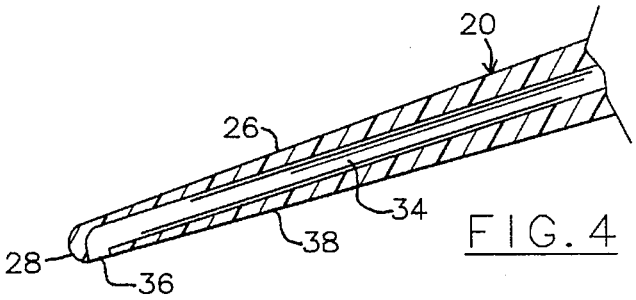
FIG. 4 is an enlarged detail elevational view of the outer end of an applicator finger.

The fingers 20, five of which are shown in the preferred embodiment as illustrated in the drawings, are preferably generally parallel to each other, and parallel to the longitudinal axis of the body 16 which lies along Section 3—3 as represented in FIG. 2. The fingers 20 are, preferably, of a conical tapered configuration having tapered sides 26 which converge toward the fingers free terminal ends 28 which are of a rounded convex configuration, FIG. 4. The tapered configuration of the fingers 20 causes the fingers to have a transverse cross sectional area which uniformly increases from the outer ends 28 of the fingers toward the fingers' inner ends extending from the body 16.

A manifold passage 30 is defined within the body 16 transversely related to the length of the fingers 20, and the manifold passage 30 extends substantially the width of the body 16. A supply passage 32 is defined within body 16 and the supply passage 32 communicates with the manifold passage 30 and the cavity 22 whereby hair treatment liquid within the cavity 22 will be supplied to manifold passage 30.

Each of the fingers 20 is provided with a longitudinally extending passage 34 having an inner end or inlet intersecting the manifold passage 30 whereby the finger passages 34 will be supplied from the manifold passage 30. The outer ends of the finger passages 34 are each provided with an outlet 36 which, as will be appreciated from FIG. 4, intersects the underside 38 of the associated finger 20 adjacent to the associated finger end 28, but spaced slightly rearwardly or inwardly thereof. As will be appreciated from FIG. 4, the finger passage outlet 38 extends downwardly to intersect the finger underside 38 and the outlet 36 does not comprise a portion of the forward convex end of the associated finger.

Th passages 30, 32 and 34 are formed by conventional techniques, and if the body 16 is molded these passages may be formed by known coring and plugging procedures.

The hair liquid applicator 10 is primarily used to apply hair gels or coloring to the root area of hair adjacent the scalp. Accordingly, the desired liquid is placed within the bottle 12 after the bottle has been unscrewed from cavity threads 24. After filling of the bottle 12, the applicator 10 is then screwed upon the bottle neck 14 establishing communication between the interior of the bottle and the cavity 22.

In use, the applicator 10, with the bottle 12 attached thereto, is first placed adjacent the crown of the head at the front hair line and the finger ends 28 will be touching the scalp, and the applicator is pushed back through the hair along the crown. This movement permits the fingers 20 to separate the hair adjacent the scalp. The applicator is then slowly retracted while the finger ends 28 maintain engagement with the scalp and the sides of the bottle 12 are gently squeezed to force the hair treatment liquid into the cavity 22 and into the passages 32, 30 and 34 for ejection from the finger passage outlets 36. As the outlets 36 are disposed toward the scalp and the hair root area, the hair treatment liquid will be directly applied to the root area as the applicator is retracted, and during retraction, the applicator is preferably zigzagged approximately one-half inch to the right and left applying the treatment liquid directly to the hair root area. This procedure is repeated, repositioning the applicator fingers upon the scalp on opposite sides of the crown as is necessary to treat all of the hair roots and the hair treating liquid, such as color or gels, will be applied directly to the hair root area, leaving the hair ends dry and untreated.

After the liquid has been thoroughly applied to the hair root area, gentle massaging of the hair will work the liquid well into the roots and the hair may then be washed or otherwise cleansed to remove the treating liquid therefrom.

Because the finger passage outlets 36 are disposed downwardly and only intersect the underside 38 of the fingers 20, the edges defining the outlets 36 are not disposed in a "forward" direction as the fingers are initially moved across the scalp, and the likelihood of hair snagging and pulling upon the edges of the outlets 36 is substantially eliminated. Further, by disposing the outlets 36 downwardly, the treating liquid will be directly applied to the hair root area and most efficiently utilized.

The applicator 10 may be easily cleaned by placing a cleansing solution within the bottle 12 and forcing the solution through the applicator passages. Also, the nature of the applicator permits different hair treatment liquids to be readily substituted one for the other if using a common applicator, but because the applicators can be inexpensively formed using high production molding techniques, it is possible to have an applicator for each standard hair color used in beauty parlors.

It will be appreciated that various modifications to the inventive concepts may be apparent to those skilled in the art without departing from the spirit and scope of the invention.

I claim:

1. An applicator for applying liquid to hair adjacent the scalp comprising, in combination, a body having a longitudinal axis, a stem defined on said body, a circular cavity defined in said body stem having an axis obliquely angularly disposed to said body axis and having an inner surface, threads defined on said cavity inner surface, a flexible squeeze bottle having a threaded neck for receiving a hair treatment liquid, said bottle neck being threaded into said body cavity, a plurality of elongated substantially parallel spaced fingers extending from said body substantially parallel to said body longitudinal axis, each finger including a free terminating end, upper and lower sides and an inner end attached to said body, a passage defined in each of said fingers, each passage including an outlet intersecting the associated finger lower side adjacent the terminating end thereof and an inlet located within said body, a manifold passage defined in said body, each of said finger passages' inlets communicating with said manifold passage, and a supply passage interconnecting said manifold passage with said cavity whereby upon insertion of said fingers into the hair adjacent the scalp squeezing of said bottle causes liquid to enter said cavity, supply passage, manifold passage and finger passages and be applied upon hair adjacent said finger terminating ends adjacent the scalp, said fingers' free terminating ends being of a rounded convex configuration, said finger passages' outlets intersecting only said fingers' lower sides adjacent and inwardly spaced from said rounded convex configuration whereby said passages' outlets are free of edges facing toward said fingers' terminating ends to prevent snagging of the hair upon insertion of said fingers into the hair in the direction of said finger's length.

2. An applicator for applying liquid to hair adjacent the scalp as in claim 1, the transverse cross sectional area of said fingers uniformly increasing from said fingers' free terminating ends to said fingers' inner ends.

* * * * *